United States Patent [19]

Brooks

[11] Patent Number: 4,480,715

[45] Date of Patent: Nov. 6, 1984

[54] SIGHT AND SOUND BARRIER

[76] Inventor: George E. Brooks, 920 E. Silverlake Rd., Oak Harbor, Wash. 98277

[21] Appl. No.: 428,729

[22] Filed: Sep. 30, 1982

Related U.S. Application Data

[63] Continuation of Ser. No. 249,129, Mar. 30, 1981, abandoned.

[51] Int. Cl.[3] ..... E04B 1/344; E04B 1/82; B32B 3/30

[52] U.S. Cl. ..... 181/287; 181/291; 181/DIG. 1; 428/71; 428/161; 428/162; 428/163; 428/167; 428/173; 428/906

[58] Field of Search ..... 428/71, 906, 138, 159, 428/160, 161, 162, 163, 314.4, 167, 169, 170, 173; 160/84 R, 231 R, 231 A, 351; 181/287, 288, 295, 291, 294, DIG. 1

[56] References Cited

U.S. PATENT DOCUMENTS

| | | | |
|---|---|---|---|
| 3,016,317 | 1/1962 | Brunner | 428/167 |
| 3,192,099 | 6/1965 | Beckman et al. | 428/160 |
| 3,284,819 | 11/1966 | Nissen | 428/159 |
| 3,389,195 | 6/1968 | Gianakos et al. | 428/304.4 |
| 3,537,116 | 11/1970 | Kain | 428/121 |
| 3,573,153 | 3/1971 | Ryan, Jr. | 428/316.6 |
| 3,899,860 | 8/1975 | Newell | 428/45 |
| 4,032,689 | 6/1977 | Johnson et al. | 428/138 |
| 4,128,683 | 12/1978 | Nomura et al. | 428/138 |
| 4,199,639 | 4/1980 | Ronc | 428/138 |

*Primary Examiner*—William J. Van Balen
*Attorney, Agent, or Firm*—Seed and Berry

[57] ABSTRACT

A portable, free-standing sight and sound barrier comprises a covered core of a lightweight, resilient foam. The core is flexible because it has alternating wall and hinge portions. The hinge portions are thinner parts of the core, generally being between about $\frac{3}{8}$–$\frac{1}{2}$ inch thick. Suitable core materials are polyethylenes, polystyrenes, urethanes, or mosaic composites of these foams. Suitable coverings are fabrics, foils, paper, or paints, depending on the particular use contemplated for the barrier.

5 Claims, 9 Drawing Figures

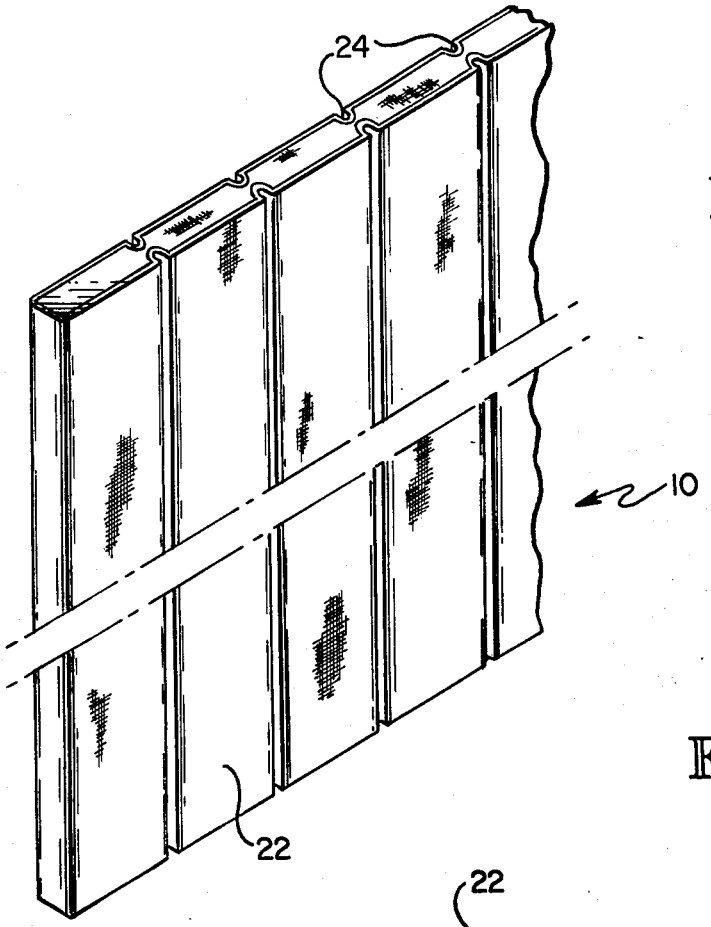
FIG. 1
FIG. 2
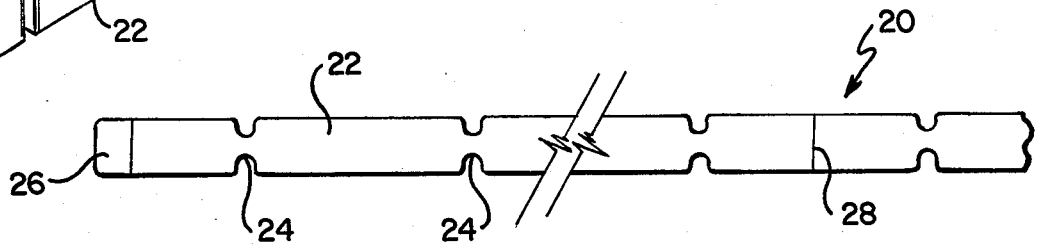
FIG. 3
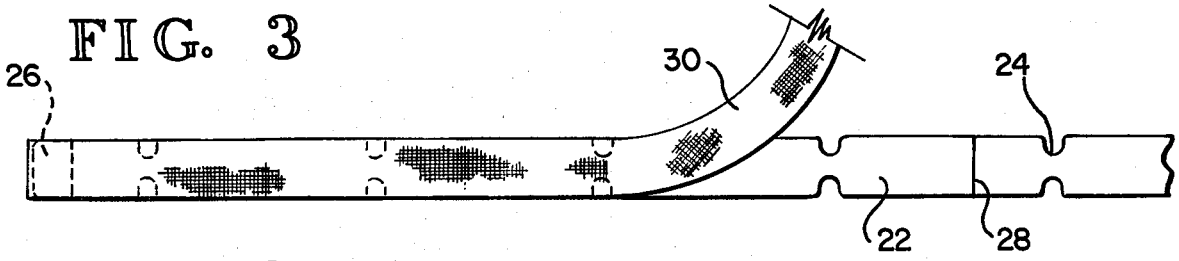
FIG. 4
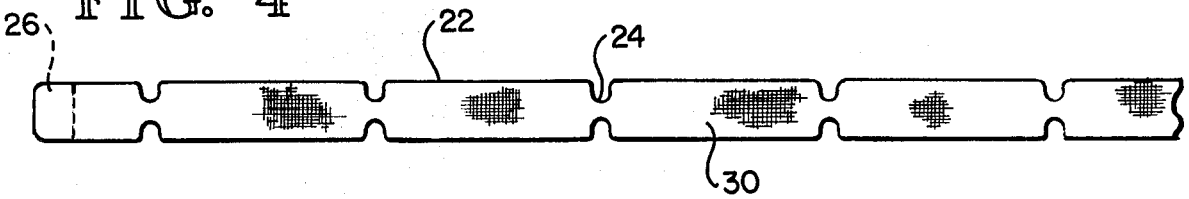
FIG. 5
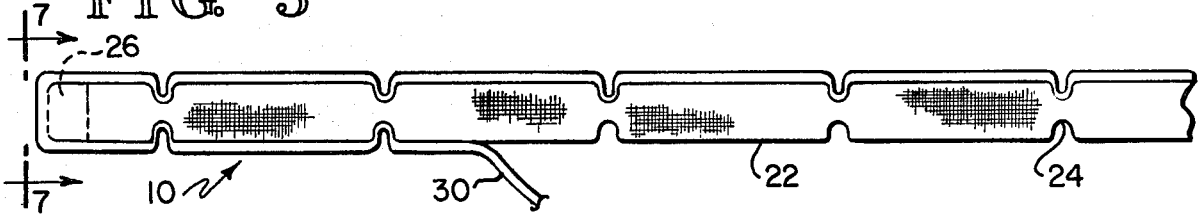

SIGHT AND SOUND BARRIER

This application is a continuation of U.S. patent application Ser. No. 249,129, filed Mar. 30, 1981 abandoned.

DESCRIPTION

1. Technical Field

This invention relates to portable, free-standing walls which, among other uses, function as sight and sound barriers. More particularly, this invention relates to a foam core and to a covered barrier made with that core.

2. Background Art

There is often a need for subdividing a room or open space into smaller areas and frequently only for a short period of time. Temporary walls may be erected, but to do so is expensive. Room dividers or screens of wood or rattan may be used, but they often fail to function as effective sound barriers, and may be difficult to handle and store.

DISCLOSURE OF INVENTION

This invention solves several problems of the prior art by introducing a versatile, durable, inexpensive, attractive, portable, free-standing sight and sound barrier wall which has potential other uses such, for example, as a crash pad on gymnasium walls, privacy barrier in restaurants, a display backdrop and traffic delineator for exhibitions, a sleeping pad, or a tumbling mat. Within minutes, the wall may be erected to subdivide rooms into smaller work or play areas. The wall may be rolled into a compact unit for storage or may be stored upright against existing walls for improved room acoustics.

The sight and sound barriers of this invention have a flexible sheet of lightweight, resilient foam as a core. This core is covered by a fabric or other suitable covering to further enhance the acoustic properties and to make the walls attractive. The core of polyethylene, polystyrene, urethane, or a mosaic thereof, for example, is made flexible with alternating wall and hinge portions. Each hinge portion has a thickness of between about $\frac{3}{8}$–$\frac{1}{2}$ inch so that the barrier may be rolled and bent without breaking the hinge. The foam is resilient so that pressure marks are temporary. When dented, the foam recovers in a few hours. Being resilient allows more permanent adherence of the fabric to the core because the core will tend to compress on bending, while it recovers when the barrier is straightened. Thus the core and fabric act as one piece rather than two. Loosening of the adhesive between them, especially at the hinges, is reduced.

When made of a core of polyethylene foam and a polypropylene fabric cover, the sight and sound barriers of this invention are extremely light, weighing about 10 ounces per square foot. The barriers are nearly indestructable, resisting staining and puncturing. They are available in virtually any height or length so that they are suitable for almost any need. Needing no hardware to use, they are easy to install, attractive, and extremely versatile.

BRIEF DESCRIPTION OF THE DRAWINGS

FIG. 1 is an isometric view of a sight and sound barrier of this invention.

FIG. 2 is an end elevation of a core for the sight and sound barrier of this invention.

FIG. 3 is a view similar to FIG. 2, showing attachment of fabric to the end.

FIG. 4 is another view similar to FIG. 2, showing trimmed fabric adhered to the end.

FIG. 5 is another view similar to FIG. 2, showing attachment of fabric to the sides of the core.

BEST MODE FOR CARRYING OUT THE INVENTION

Figure 6:
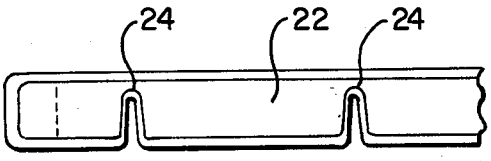
FIG. 6 is an end elevation of an alternate barrier.
Figure 7:
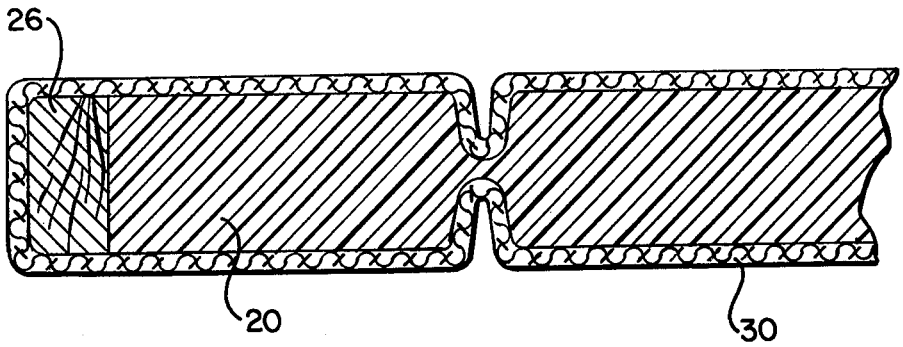
FIG. 7 is a detailed section of a sight and sound barrier of this invention.

The sight and sound barrier of this invention has a core 20 of lightweight, resilient foam and a covering 30 adhered about all the sides of the core 20. The core 20 is flexible because it has alternating wall 22 and hinge 24 portions. The hinge portions 24 are thinner sections of the foam and are generally made by routing grooves out of uniformly thick sheet of foam. However, the foam can be otherwise formed with the grooves.

Many materials may be used to make these barriers 10. The foam for the core may be selected from the group consisting of polyethylenes, polystyrenes, and urethanes. Ethaform 220, a trademarked product of the Dow Chemical Co., is a particularly desirable foam. The covering may be a fabric, foil or paper product or a painted-on material. However, a covering with good acoustical properties is preferred. All types of decorative fabrics may be used, although polypropylene berberib material has been found to be particularly desirable, in which case 3M's adhesive glue #4693 is preferred. However, other suitable adhesives may be used.

The following discussion will focus upon construction of a preferred sight and sound barrier made from polyethylene foam and a polypropylene fabric covering. A typical thickness and height will be used for purposes of example only.

To make a 2-inch thick, 60-inch high wall, a piece of raw foam is cut to provide a reference edge. The foam is then ripped to form 36-inch by 61-inch sheets. On each side of the sheets, grooves are plowed. Each groove has tapered sides and a $\frac{5}{8}$-inch radius at the bottom. The grooves begin 3 inches on center from the edge of each sheet, are 6 inches apart, and run the length of the sheet. Once plowed, the grooves provide a thinned hinge portion 24 having a thickness of about $\frac{3}{8}$ to $\frac{1}{2}$-inch. As an alternative to grooves on both sides, a single deep groove may be made on one side of the foam to form a hinge (FIG. 6).

The edges of the sheets are sprayed with an adhesive to develop a heavy build, and the sheets are adhered together to form a panel, squeezing along the seam 28 until well bonded. End caps 26 may be added to make the first and last wall portion 22 six inches long. The end caps 26 usually are foam, but a wood strip may be used if the wall is to be tracked to a building structure for additional support.

Once glued together, the edges of each groove are routed with a $\frac{3}{8}$-inch radius, and the top and bottom ends are trimmed with a straight edge and skill saw to an overall length of $59\frac{1}{2}$ inches. A heavy build of adhesive (about four coats from a Binks 66SS fluid nozzle/66S D cap at 25 psi air and 45 psi fluid pressure at about 70° F.) is sprayed onto the ends and let dry. During the drying, the sides of the panel are perforated with ⅝-inch deep, 3/32-inch diameter perforations using a saber saw with a custom 24-point perforator block. These perforations improve the acoustic properties of the foam and enhance its resiliency when covered.

Four coats of adhesive are also placed on 2½ inch wide strips of fabric (FIG. 3). When nearly dry, each strip is applied to a top or bottom edge of the panel with one edge of the strip flush with one face of the panel. The other edge of the fabric strip is then trimmed to be flush with the other panel face. Each groove is trimmed so that the fabric is flush with the foam surface (FIG. 4).

Fabric for the panel faces is cut, leaving about a 2-inch overlap for the top and bottom (roughly a 64-inch wide sheet for making this 60-inch panel). The fabric is then rolled with the good side in, preparatory to its application. At the fourth groove from an end of the panel, adhesive is sprayed over that wall portion to provide a heavy build. Adhesive is also sprayed onto the first 10 inches of fabric. The fabric is then adhered to the first glued wall portion with hand pressure, allowing two to three minutes to dry. The next wall portion and fabric portion are sprayed with two slow (yet heavy) passes of the spray gun. While still slippery with the adhesive, the fabric is pressed into the groove and pressed with a wood straight-edge mold to insure its contact over the entire length of the groove. A coaster wheel is run along the length of the groove with about 25–40 pounds of pressure to insure contact of the fabric with the glued foam. If the fabric is ribbed, care should be taken to keep the ribs parallel to the grooves. Gluing continues as just described for each wall and hinge portion.

At the end of the fabric roll, a straight edge is cut and the fabric glued to the middle of a wall portion. A new fabric roll is prepared. Gluing begins on the next uncovered wall portion, leaving sufficient fabric to form a seam later. A seam is formed by overlapping the two fabric ends and cutting through both pieces at once. After removing the trim piece from beneath and applying the adhesive (if necessary), the trimmed ends are pressed into place. The method of seaming together the fabric portions is also used in covering the three panels initially skipped.

With the fabric glued over both faces and both edges of the panel, the overlap at the top and bottom ends is trimmed at about a 60 degree angle to the ends. To insure a bond, the trimmed fabric edges are pressed together. Fabric fuzz is trimmed to make the sight and sound barrier ready for final drying. About one-half hour is required to insure proper drying. Once dried, the barrier may be rolled into a circle (the hinges will dictate the smallest radius possible) and wrapped in plastic for storage. Air may be blown over the faces to remove dust and other debris from the fabric.

The barrier need not be made of one type of foam or of one type of covering only. A mosaic of foams may be used, such as alternating sections of polyethylene and polystyrene glued together. The faces of the panels may be covered with different coverings; one face may have a mosaic.

Figure 8:
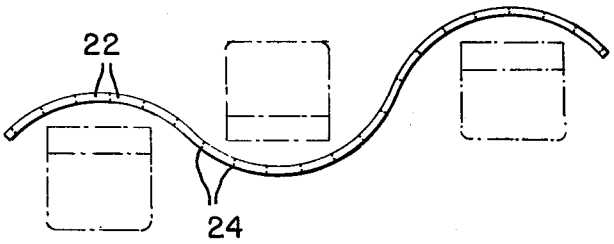
FIG. 8 is a schematic top plan of the sight and sound barrier in a free-standing, zig-zag arrangement.
Figure 9:
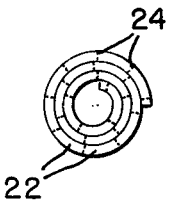
FIG. 9 is a schematic top plan of the sight and sound barrier rolled for storage.

Thus the sight and sound barrier 10 of this invention has alternating wall 22 and hinge 24 portions of a lightweight, resilient foam core 20 and a covering 30 adhered around all exposed sides. The hinge portions 24 allow the barrier 10 to be bent so that it can free-stand by being placed in a zig-zag arrangement or smooth curve (as shown in FIG. 8) and can be rolled for storage (as shown in FIG. 9). The fabric facing the hinge portions of the foam helps to strengthen the hinge. The foam core 20 compresses on bending so that the adhesive seal between the core 20 and covering 30 is not broken. When the barrier 10 is straightened, the foam core 20 returns to its original shape. This resiliency makes the barrier 10 useful for many activities other than acoustical soundproofing.

Those skilled in the art will recognize numerous modifications to the particular embodiments shown and described. Therefore, this invention should not be limited to a particular embodiment, unless limitation is necessary due to the prior art or to the nature and spirit of the appended claims.

I claim:

1. A portable, free-standing sight and sound barrier comprising:

(a) an integral core of a lightweight, resilient foam which possesses cushioning and sound-absorbing properties, the core having alternating wall and hinge portions of foam defining a length of the barrier, the hinge portions allowing the barrier to assume smoothly curving configurations while the wall portions remain substantially straight and erect between successive hinge portions, each wall portion having a thickness sufficient to support the barrier when the barrier is placed on end, each hinge portion being defined by aligned pairs of grooves in spaced, substantially parallel array, each pair of grooves extending along the entire width of the barrier from end to end substantially perpendicular to the longitudinal axis of the barrier and impending by tapered side walls to substantially equal depths from opposite faces of the wall portions to form a thinned resilient hinge portion which is equally flexible in both directions; and (b) a fabric cover adhered to the foam over the wall and hinge portions to cover substantially the entire surface of the foam, the cover being adapted to provide additional strength and resiliency for the hinge portions.

2. The barrier of claim 1 in which the core is about two inches thick and the hinge portion is about one-half inch thick.

3. The barrier of claim 1 in which the foam material of the hinge portions is not crushed.

4. The barrier of claim 1 in which the longitudinal side edge portions of the core are also covered with fabric strips adhered to the foam, the longitudinal side edges of said strips being cut away at the hinge portions of the core to match the end profile of the core.

5. The barrier of claim 4 in which at least one vertical end of said core is connected to a wood end cap covered by the fabric.

* * * * *